US006102142A

United States Patent [19]

Besson et al.

[11] Patent Number: 6,102,142

[45] Date of Patent: Aug. 15, 2000

[54] DRILLING TOOL WITH SHOCK ABSORBERS

[75] Inventors: Alain Besson, Saint-Remy-les-Chevreuses, France; Robert Delwiche, Brussels, Belgium; Pierre Lecour, Bicetre, France

[73] Assignees: Total,, Putaux, France; Security Diamint Boart Stratabit, Brussels, Belgium

[21] Appl. No.: 08/996,196

[22] Filed: Dec. 22, 1997

[30] Foreign Application Priority Data

Dec. 24, 1996 [FR] France ..... 96 15960

[51] Int. Cl.[7] ..... E21B 10/00

[52] U.S. Cl. ..... 175/426; 175/325.1; 175/325.4; 175/425; 175/412

[58] Field of Search ..... 175/412, 426, 175/425, 325; 51/309

[56] References Cited

U.S. PATENT DOCUMENTS

| | | | |
|---|---|---|---|
| 3,618,683 | 11/1971 | Hughes | 175/426 |
| 4,244,432 | 1/1981 | Rowley et al. | 175/329 |
| 4,253,533 | 3/1981 | Baker, III | 175/428 |
| 4,499,795 | 2/1985 | Radtke | 76/108 A |
| 4,640,375 | 2/1987 | Barr et al. | 175/410 |
| 5,011,515 | 4/1991 | Frushour | 51/309 |
| 5,072,812 | 12/1991 | Imaizumi | 188/282 |
| 5,090,492 | 2/1992 | Keith | 175/410 |
| 5,372,548 | 12/1994 | Wohlfeld | 464/20 |
| 5,377,772 | 1/1995 | Gien | 175/325.5 |
| 5,379,854 | 1/1995 | Dennis | 175/426 |
| 5,499,688 | 3/1996 | Dennis | 175/426 |

FOREIGN PATENT DOCUMENTS 532 869 3/1993 France .

*Primary Examiner*—Eileen Dunn Lillis
*Assistant Examiner*—John Kreck
*Attorney, Agent, or Firm*—Sughrue, Mion, Zinn, Macpeak & Seas, PLLC

[57] ABSTRACT

A drilling tool including a drilling head equipped with cutting edges and fitted with several shock-absorption elements, of which at least one part is made of an elastomer material. Each shock-absorption element having a block incorporating one portion inserted inside a receptor housing formed on the tool surface, and a portion which projects outward beyond the receptor housing.

19 Claims, 3 Drawing Sheets

DRILLING TOOL WITH SHOCK ABSORBERS

FIELD OF THE INVENTION

The present invention concerns a drilling tool equipped with means allowing absorption of the vibrations of which it is the focal point during the drilling procedure. These vibrations, which are generated most notably when the tool encounters heterogenous or hard strata, can sometimes cause the destruction or damage of certain sensitive parts of the tool, for example the cutting unit.

TECHNOLOGICAL BACKGROUND OF THE INVENTION

U.S. Pat. No. 4,253,533 discloses a drilling tool fitted with two runners made of elastomer and arranged diametrically, and, between the latter, a plurality of cutting edges made of diamond or a comparable material. The height of these runners is less than that of the cutting edges, with the result that only the ends of these cutting edges project outward from the outer surface of the runners. Accordingly, penetration of the cutting edges into the stratum is limited to a depth at most equal to the distance by which they extend beyond the runners. As a result, the cutting edges undergo only stresses that are much weaker that the forces they would have underdone had the entire length thereof penetrated into the rock.

However, these runners prove totally ineffective in absorbing the vibrations generated on the tool during drilling operations.

Patent No. EP 0 532 869 discloses a drilling tool containing a cavity in which a feed duct supplying an irrigation fluid empties, said cavity comprising a thin wall which incorporates an orifice through which the fluid can flow to the outside, and an opening in which a flat cylindrical element made of an elastomer is set in position. When acted upon by the pressure of the irrigation fluid in the cavity, the elastomer element undergoes deformation in the manner of a diaphragm, and the exterior surface thereof forms fluid-tight contact with the wall of the newly-drilled stratum, said contact, when the stratum is ductile, having the effect of compressing said exterior surface and protecting it from the impact generated by the irrigating fluid. Here, too, it can be seen that the elastomer block cannot dampen the vibrations of the tool.

SUMMARY OF THE INVENTION

The present invention proposes a drilling tool fitted with shock-absorbing elastomer blocks which damp the tool vibrations, thereby protecting the cutting edges from any damage.

Surprisingly, the shock-absorbing elastomer blocks have been shown to provide good resistance to wear, even though they function under very severe conditions, such as high temperatures and strong shear forces. This property, combined with their natural elasticity, allows effective absorption of drilling tool vibrations.

BRIEF DESCRIPTION OF THE FIGURES

The invention will be better understood from a reading of the following detailed description, which refers to the attached drawings, in which.

DETAILED DESCRIPTION OF PREFERRED EMBODIMENTS OF THE INVENTION

Figure 1:
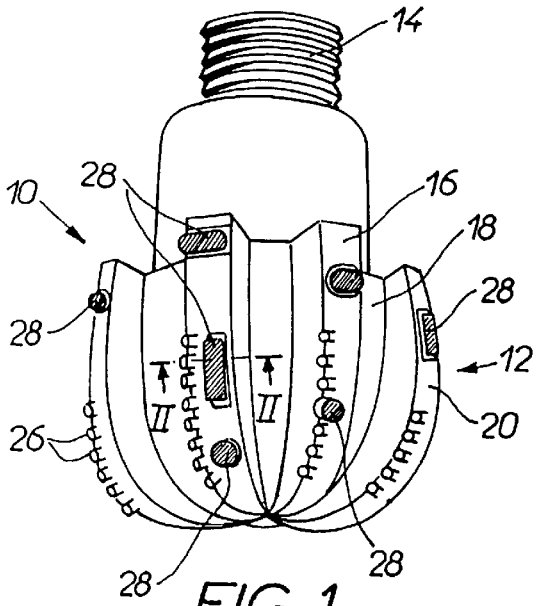
FIG. 1 is a perspective view of a one-piece drilling tool fitted with shock-absorption elements according to the invention.

The invention will be explained with reference to a one-piece blade-equipped drilling tool 10 as shown in FIG. 1, and to the tricone bit illustrated in FIG. 3; however, the embodiment chosen does not limit the invention, since the latter encompasses all types of one-piece drilling tools and tools incorporating rotary conical wheels.

In conventional fashion, the tool 10 in FIG. 1 comprises a drilling head 12 fitted with an externally-threaded, tubular connection piece 14, which is used to connect the tool to a series of drive tubes (not shown). A plurality of ribs, or blades 16 separated by grooves 18 are formed around the head.

The exterior face 20 of each blade incorporates a series of cutting edges 26 of any conventional type, which are formed, for example, by chips made of natural or synthetic diamond, polycrystalline diamond composite (PDC), or thermostable diamond. The cutting edges are either set into the blade or held by tungsten carbide stems fastened to the tool.

According to the invention, the tool is fitted with a plurality of shock-absorption elements 28 designed to damp the vibrations generated on the tool during the drilling operation.

The shock-absorption elements 28 may be fastened to any part whatever of the tool, and, for example, to the exterior face 20 of the blades or to the guard plate of the tool.

Figure 3:
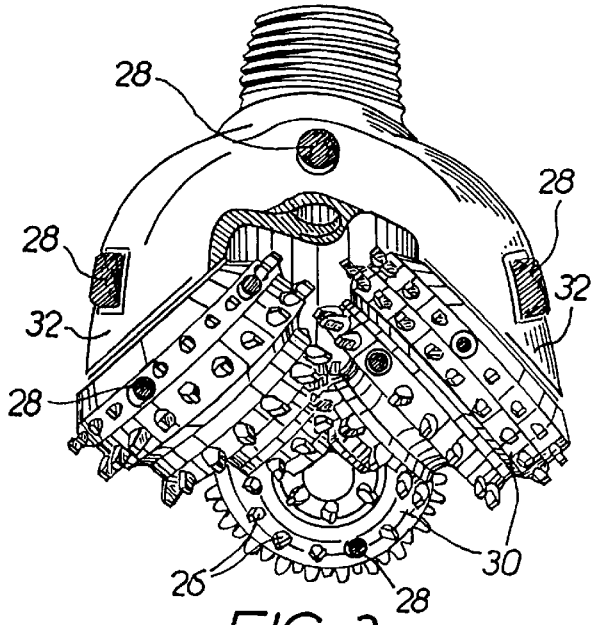
FIG. 3 is a perspective view of a tricone drilling tool equipped with shock-absorption elements according to the invention.

In the tricone bit in FIG. 3, the shock-absorption elements 28 are attached to the conical wheels 30, for example between the cutting edges 26; or between the rows of cutting edges or on the periphery of the wheels, or, again, to the arms 32 supporting the wheels.

Each shock-absorption element 28 exists as an elastomer block which may have any suitable shape; for example, cylindrical, parallelepipedal, cubic, pyramidal, truncated, or spherical. The block is embedded over a portion of its length inside a receptor housing formed on the tool surface, and the remaining portion of its length projects outward from the housing, thereby forming a projection extending beyond the tool surface.

Figure 4:
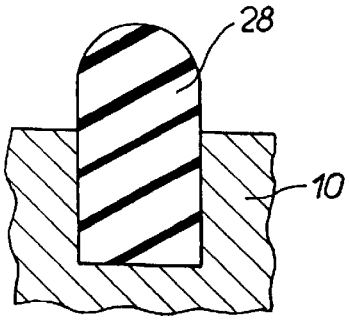
FIG. 4 is a partial, enlarged cross-section of an elastomer block set in position in the tool, according to a first embodiment.
Figure 2A:
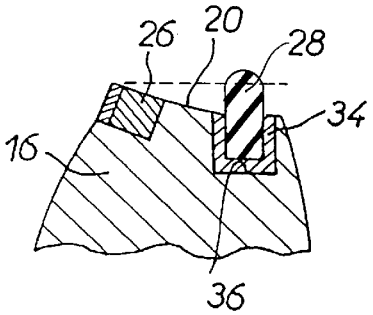
FIGS. 2*a*–2*c* are enlarged cross sections of various embodiments taken along line II—II in FIG. 1.
Figure 2B:
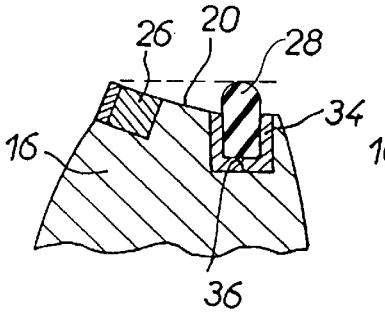
Figure 2C:
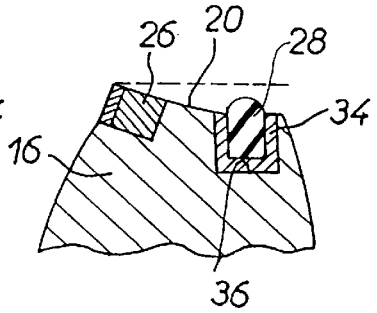

As shown in FIG. 2 the blocks are set inside sheaths 34 having the shape of sealed-bottom tanks, said sheaths being fixed in position, in turn, in recessed housings 36 formed in the tool surface. They may also be inserted directly inside the housing 36, without using a sheath (FIG. 4).

The height of the blocks extending above the tool surface may be equal to, less than or greater than the height of the cutting edges extending above the tool surface, so that the vertices thereof may be located on the same level, below, or above the vertices of the cutting edges.

Figure 5:
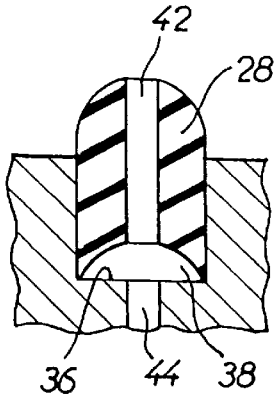
FIG. 5 is a cross-section of an elastomer block incorporating an axial duct.

In the embodiment shown in FIG. 5, the block 28 is separated from the bottom of the housing by a chamber 28. In order to allowing balancing of the hydrostatic pressure generated on the block and, in consequence, the unrestricted deformation of the block, the chamber 28 must be connected to the outside environment. This connection may be accomplished either by an axial duct 42 drilled in the block, by a duct 44 drilled in the tool, or again, by two ducts simultaneously. In this way, the elasticity of the block, and thus its shock-absorption power, is improved.

Figure 6:
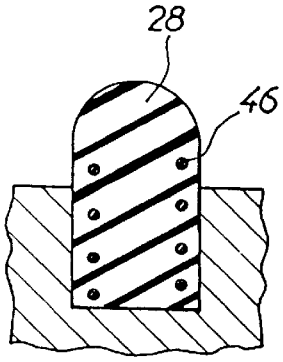
FIG. 6 illustrates an elastomer block reinforced with a helicoidal spring.

FIG. 6 illustrates a block 28 in which a helicoidal spring 46 is embedded. This spring improves the strength and the elasticity and shock-absorption performance levels of the block.

Figure 7:
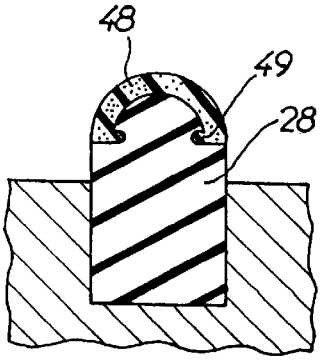
FIG. 7 illustrates an elastomer block protected by an abrasion-fighting layer.

The projecting portion of the surface of the block in FIG. 7 is covered with a relatively hard abrasion-fighting layer 48, made, for example, of tungsten carbide or by diamond concretion. This block has a longer life than the preceding block. The layer 48 is attached using an annular flange 49, which snaps into an annular groove formed in the upper part of the block; however, it could also be adhesively bonded in place.

Figure 8:
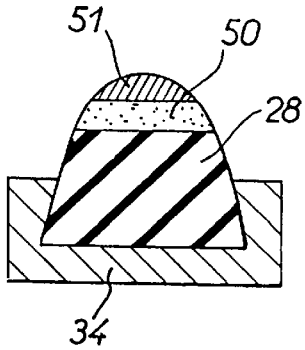
FIG. 8 shows an elastomer block fitted with an abrasion-fighting cap.

In the embodiment in FIG. 8, the block 28 is truncated, and the projecting portion thereof is protected by an abrasion-fighting cap 50 made of tungsten carbide. The cap may, in turn, be covered with a dome-shaped tip 51 made of PDC. The lower portion of the block 28 is set by force inside a tapered housing possessing a matching shape and formed inside a sheath 34.

Figure 9:
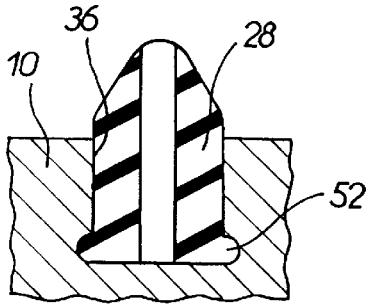
FIG. 9 shows an elastomer block, the bottom of which is fitted with a flange designed to hold the block in place in a receptor housing.

The block shown in FIG. 9 comprises, at the base thereof, a projecting peripheral flange 52 which is inserted in a corresponding circular groove formed in the lateral wall of the housing 36 and on the bottom thereof. In this way, the block is held in place, thereby preventing it from slipping out accidentally.

Figure 10:
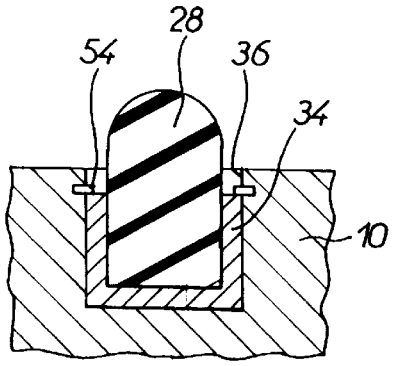
FIG. 10 illustrates an elastomer block set in a sheath, which is, in turn, held in place in a housing by means of an elastic split ring.

In the variant embodiment shown in FIG. 10, the sheath 34 is held in place in the housing 36 by means of a elastic split ring 54, which is inserted in a peripheral groove formed at the housing entrance.

Figure 11:
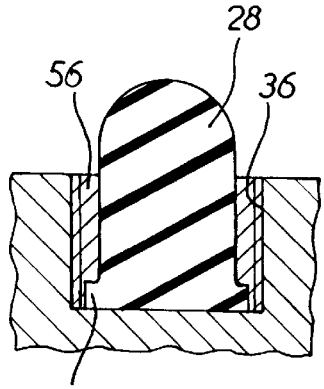
FIG. 11 illustrates an elastomer block set in a sheath, which is screwed into the receptor housing.

Another means for holding the block in place in the housing is illustrated in FIG. 11. The base of the block is fitted with a peripheral flange 52 and is held in an externally-threaded ring 56, which is provided with a counter-bore intended to house the flange. Mounting is accomplished by inserting the lower end of the block into the ring, then by screwing the ring into the housing 36. The block cannot then come out of its housing.

Figure 12:
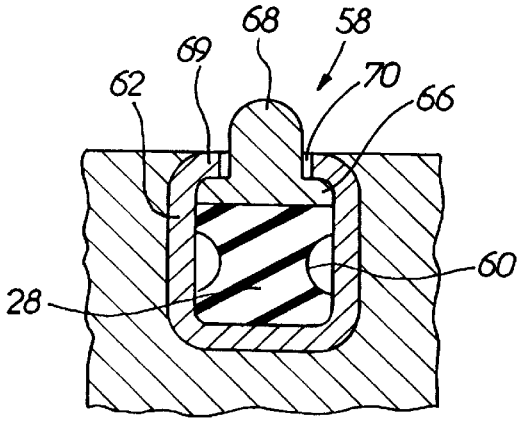
FIG. 12 illustrates a two-piece shock-absorption element.

In the embodiment illustrated in FIG. 12, the shock-absorption element is formed from two parts: an elastomer block 28 having a cylindrical or parallelepipedal shape, and a slug 58 made of a hard material, for example tungsten carbide, which rests on the block 28. The block incorporates, at mid-height, a peripheral groove 60 which imparts to it increased compressibility. The block fits into a tank-shaped housing 62 whose height is slightly greater than that of the block.

The slug 58 comprises a flat base 66 having the same surface area as the elastomer block and fitted in the center of its upper face with a finger 68 having a smaller section. At the time of assembly, the block is set into the housing until it comes into contact with the bottom, then the slug base is inserted in the housing, and the upper edges 69 of the housing are pressed down over the base. The base is then held in a sandwich arrangement between said folded edge and the elastomer block. The finger 68 projects outward from the housing through an orifice 70 whose section slightly exceeds that of the finger. The assembly thus produced is then fastened to the tool.

Figure 13:
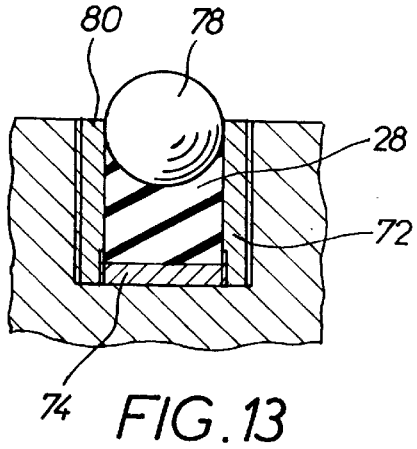
FIG. 13 shows a variant embodiment of the shock-absorption element in FIG. 12.

In the embodiment in FIG. 13, the housing is made in two parts: an externally-threaded tubular ring 72 and a bottom 74, which is screwed into the lower end of the ring.

This housing holds an elastomer block 28 which rests on the bottom 74 and a portion of a ball 78 made of steel, tungsten carbide, or a diamond-charged material. One portion of the ball, which is smaller in volume than a half-sphere, projects outward beyond the ring.

On its upper surface, The elastomer block incorporates a hemispherical seat on which the ball rests. The ball is held in place by one inwardly-curved edge of the ring.

In the preceding two embodiments, no part of the elastomer block 38 is in contact with the rock. The tool vibrations are transmitted by the tungsten carbide component to the block, which dampens them.

Figure 14:
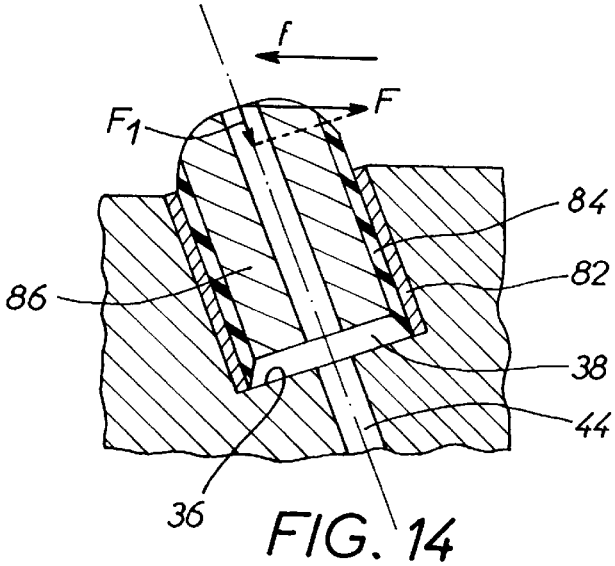
FIG. 14 illustrates another embodiment of a two-piece shock-absorption element.

The shock-absorption element illustrated in FIG. 14 is made in three pieces. It comprises a tubular sheath 82 fastened in place in the housing 36, a tubular elastomer sleeve 84 which covers the inner wall of the sheath, and a center part 86 made of steel or tungsten carbide, which is fixed in position without friction inside the sleeve. This sleeve extends over the entire height of the sheath and extends slightly above the upper end of the sheath. The center part 86 projects outside the sheath, and the lower end thereof is spaced apart from the bottom of the sheath.

As in the embodiment shown in FIG. 5, the chamber 38 connects with the outside, either directly through an axial passage 42 drilled in the center part or through a passage 44 formed in the tool.

In contradistinction to the preceding embodiments, the main axis of the shock absorber is inclined in the direction of movement f of the tool. The advantage of such positioning lies in the fact that it reduces the rocking motion of the center part 86, since the force of reaction F exerted on the center part in the direction opposite the arrow f has a component $F_1$, which is generated along the axis of the part 86 and which, accordingly, exerts no rocking motion on the part.

When in operation, the part 86 thus undergoes an alternating motion which is basically directed in the direction of the axis of the housing 36. The sleeve 84, which is squeezed between a fixed component (i.e., the sheath 82) and a moving part (i.e., the center part 86), is, therefore, subjected to pronounced shear stresses which dampen the amplitude of the tool vibrations.

What is claimed is:

1. A drilling tool, comprising a drilling head equipped with cutting edges, wherein said drilling tool is also fitted with a plurality of shock-absorption elements (28; 68; 78; 84, 86) of which at least one part is made of an elastomer material, each of said shock-absorption elements being made as a block, which comprises one portion set in position inside a housing (36) formed on the surface of the tool and a portion which projects beyond said housing, and which can be deformed while absorbing tool vibrations.

2. The drilling tool according to claim 1, wherein the height of the projecting portion of the blocks is greater than the height of the cutting edges (26).

3. The drilling tool according to claim 2, wherein the block is set in place in a sheath (34; 72), which is, in turn, fixed in position in the housing (36).

4. The drilling tool according to claim 1, wherein the height of the projecting portion of the blocks is equal to the height of the cutting edges (26).

5. The drilling tool according to claim 1, wherein the height of the projecting portion of the blocks is less than the height of the cutting edges (26).

6. The drilling tool according to claim 1, wherein the shape of the block is selected from the group consisting essentially of cylindrical, hemispherical, pyramidal, truncated, parallelepipedal, and conical.

7. The drilling tool according to claim 1, wherein a location of blocks is selected from the group consisting essentially of a tip, a blade (16), and a guard plate of a one-piece tool, or rotating conical wheels (30), arms (32) and a guard plate of a tool incorporating wheels.

8. The drilling tool according to claim 1, wherein an elastic reinforcing piece, designed to be compression-prestressed is embedded within the block.

9. The drilling tool according to claim 1, wherein the portion of the block which projects beyond the housing (36) is coated with an abrasion-fighting protecting coating (48, 50).

10. The drilling tool according to claim 9, wherein the protecting coating is, in turn, covered with a dome-shaped tip (51) made of PDC.

11. The drilling tool according to claim 1, wherein the block is strengthened by incorporating into the elastomer mass a filler made of fine diamond particles.

12. The drilling tool according claim 1, wherein a chamber (38) is produced beneath the block (28) between a base of said block and a bottom of the housing (36).

13. The drilling tool according to claim 12, wherein a duct (42) connecting the chamber (32) to the outside runs through an entire length of the block (28).

14. The drilling tool according to claim 13, wherein a second duct (44) is drilled in the bottom of the housing, through which a pressurized irrigation fluid may be injected in order to expel a waste material that accumulates in the first duct (42).

15. The drilling tool according to claim 1, wherein the shock-absorption element comprises an elastomer block (28) placed in the bottom of a bowl-shaped housing (62; 72, 74), in which said block is shorter than said housing, and a second part made of a hard material (58; 78), said second part incorporating an interior portion (66) which fills the remainder of the housing and an exterior portion (68) having a small section, which projects outward from the housing, the edges (69) of the housing being folded down over the interior portion (66) so as to prevent said part (58, 78) from slipping out of the housing.

16. The drilling tool according to claim 15, wherein said part exists as a slug (58) comprising a flat base (66) having the same surface area as the elastomer block and which incorporates, in the center of the upper face thereof, a finger (68) having a small section.

17. The drilling tool according to claim 15, wherein said second part comprises a ball (78), of which one portion having a volume greater than a half-sphere is held in the housing (72, 74) and whose other portion extends beyond the housing.

18. The drilling tool according to claim 15, wherein the axis of the shock-absorption element slopes in a direction of movement (f) of the tool, in such a way that a force of reaction (F) which a stratum exerts on the shock-absorption element includes a component ($F_1$) generated along the axis of said element.

19. The drilling tool according to claim 1, wherein the shock-absorption element comprises a sleeve (84) made of an elastomer material, which fits tightly into a sheath (82), and a center part (86) fixed in position without friction inside the inner space of the sleeve, said center part being spaced apart from the bottom of the receptor housing (36) so that said center part can slide therein, and comprising the portion which projects outward from the housing and which is not covered by the sleeve.

* * * * *